US007857024B2

(12) United States Patent
Bush

(10) Patent No.: US 7,857,024 B2
(45) Date of Patent: Dec. 28, 2010

(54) SUPPORT COLLAR FOR MODULAR CEILING INSERT

(76) Inventor: Byron V. Bush, 1652 Sunset Rd., Brentwood, TN (US) 37027

( * ) Notice: Subject to any disclaimer, the term of this patent is extended or adjusted under 35 U.S.C. 154(b) by 875 days.

(21) Appl. No.: 11/528,631

(22) Filed: Sep. 28, 2006

(65) Prior Publication Data

US 2008/0078137 A1 Apr. 3, 2008

(51) Int. Cl.
*G09F 7/18* (2006.01)

(52) U.S. Cl. ..... 152/39; 362/148; 52/200

(58) Field of Classification Search ..... 52/39, 52/200, 220.8; 248/342, 343, 344; 362/148, 362/364, 365, 147, 368, 370
See application file for complete search history.

(56) References Cited

U.S. PATENT DOCUMENTS

| | | | | |
|---|---|---|---|---|
| 3,965,624 | A | 6/1976 | Madonna | |
| 4,549,375 | A | 10/1985 | Nassof | |
| 4,713,916 | A | 12/1987 | Brooks | |
| 4,729,074 | A * | 3/1988 | Steadman | 362/148 |
| 5,031,084 | A * | 7/1991 | Russo et al. | 362/365 |
| 5,130,915 | A * | 7/1992 | Lerch | 362/367 |
| 5,772,314 | A * | 6/1998 | Brumer | 362/360 |
| 5,815,900 | A | 10/1998 | Ichikawa | |
| 6,168,285 | B1 | 1/2001 | Flohre | |
| 6,582,106 | B2 * | 6/2003 | Jamison | 362/396 |
| 6,748,712 | B2 | 6/2004 | Likozar | |
| 6,883,940 | B2 * | 4/2005 | Grajetzky et al. | 362/364 |
| 6,944,995 | B2 * | 9/2005 | Duffey et al. | 52/173.1 |
| 6,957,896 | B2 * | 10/2005 | Burgess | 362/147 |

* cited by examiner

*Primary Examiner*—Brian E Glessner
*Assistant Examiner*—Adriana Figueroa
(74) *Attorney, Agent, or Firm*—Jacobson Holman PLLC

(57) ABSTRACT

Manufactured sections of a support collar which inter-engage to form the appearance of a continuous support collar and which are secured together and secured to ceiling joists form a support surface for a ceiling dome. Each of the collar sections include a grooved recess for receipt of a lighting element. End portions of the collar sections having inter-engaging male and female portions to secure the collar sections together and provide the appearance of the continuous support collar. The collar sections additionally have a weight displacement pan mounted on top of the dome to distribute weight forces of an attachment suspended from the dome.

19 Claims, 10 Drawing Sheets

SUPPORT COLLAR FOR MODULAR CEILING INSERT

FIELD OF THE INVENTION

The present invention relates to a prefabricated modular system for providing interengaged support collar sections to support a peripheral edge of a modular ceiling insert. The invention eliminates the need for costly and time consuming on-site fabrication.

BACKGROUND OF THE INVENTION

Fifty years ago, windows were made on-site and required excessive time and expertise to cut the glass, cut and place wood molding to secure the window pane, and then caulking and painting of the window. Now windows arrive at the job site either completely or partially assembled, ready for installation into a rough opening left by the framing contractor. Not only are windows now quicker and easier to install, but in short, they are much better; providing better insulation, tighter fitting tolerances, better materials which last longer and function more smoothly.

Most, if not all of today's ceilings are custom fabricated on site. This is a very time consuming process, requiring on-site skilled labor and is very costly. Whether a ceiling is a tray ceiling, coffered ceiling or some other combination, the ceiling requires extensive effort and attention to detail. Dome ceilings are rarely utilized because of the skill required to produce symmetrical curves.

One of the few exceptions to a labor intensive process is a suspended ceiling with inset tiles utilized primarily in commercial buildings in which a suspension system is installed followed by removable acoustical tiles, typically 2'×4' or 2'×2' in size. The advantages of installation are obvious and the benefits and ability to replace the tiles in the future for a different look are far superior to old style "on site" fabrication methods.

SUMMARY OF THE INVENTION

Just as windows are now modular and are almost entirely prefabricated in design, it is an object of the present invention to produce ceilings that are quick and easy to install by unskilled labor, saving time and expense; providing a superior product at a reduced cost.

It is envisioned that a family of ceiling products will be available, made in different sizes and scales in various industrial processes (example: plastic and/or composite roto-molding, structural foam/web molding, injection molding, blow molding, even wood, wood products, metal, glass, etc.), whose parts integrate together, thereby maximizing their use and flexibility with easy installation. This would help eliminate the need for costly and time consuming on-site fabrication.

One such ceiling includes a dome approximately six feet round in diameter that is manufactured at various scaled sizes. The dome is round but other designs are acceptable which are hexagonal, octagonal, rectangular, square, etc.

The working or attic surface provides the necessary structural support, while the inner surface or show side of the dome can be modified in a variety of shapes and designs and textures to offer the consumer a multitude of choices for their homes. The dome can be painted by the consumer. However, the dome will be fabricated such that painting will not be necessary. It is designed to support a light or ceiling fixture such as a ceiling fan or chandelier, but may be equally attractive if nothing is placed from the highest central point.

There is a built in provision for either a rope light or fiber optic light source, or multiple focal lights that are provided for eight foot and/or twelve foot support collars that shine or reflect up on the dome to provide an indirect lighting effect. A smooth dome or a scalloped dome are possible alternatives. A "tray version" is also available which resembles a dome but is "flat" across the top, thereby not requiring as much vertical attic space for placement. All of the elevated structures have an ability to stack or nest together to minimize space during shipping and each provides insulation to the homeowner.

To coordinate support for a six foot dome, prefabricated support collars have an outer diameter of eight or twelve feet. Combined with a six foot dome or tray, the support collars make up a total ceiling package of either an eight foot dome/tray or a twelve foot dome/tray. The support collars are manufactured in different sizes and scales to match with various dome sizes.

For example, a six foot dome reduced by 50% would produce a three foot diameter dome. If the support collars are equally reduced, they would produce a total package of a four foot dome/tray ceiling and a six foot dome/tray ceiling, adding flexibility to the number of rooms that could utilize this smaller size.

An eight foot collar is formed in quadrants, meaning that it takes four parts to make a whole supporting collar, while a twelve foot diameter collar is manufactured in one-eighth sections. Other combinations may be utilized. These collars overlap to form an integrally appearing product and attach to the ceiling joists which are reinforced prior to installation to support the weight of the modular ceiling insert. The various domes "sit" on the collars and are interchangeable. This allows for multiple uses of the same parts but achieves different decorative looks.

The collars have integrated within them the ability to place rope or fiber optic lights and/or pinpoint halogen-type lights.

Various lag bolts and washers are used to secure the collar sections to the ceiling joists and draw bolts with washers are used to pull the pieces of the collar together. Male and female portions at opposite ends of the collar portions interfit to lock adjacent collar portions together. In addition, various light kits are used including a rope light kit and a fiber optic rope light which will allow for different colors to be illuminated through the fiber and thereby reflect up against the dome. Pinpoint halogen lights are used which are inserted at an uppermost point where the collars overlap and give a different lighting effect with areas of direct lighting and areas of shadows.

A weight displacement pan may be used which is a metal pan, approximately 20-24" in diameter that sits on top of the dome in the center and is of sufficient thickness to support the weight of suspended light fixtures, chandeliers or ceiling fans and to distribute those weight forces away from the center of the dome, thereby enhancing the weight bearing capacity and longevity of the dome. The weight displacement pan may be flat or conform to the shape of the outer working surface of the dome.

Accordingly, it is another object of the present invention to manufacture sections of a support collar which interengage to form the appearance of a continuous support collar and which are secured together and secured to ceiling joists to form a support surface for a ceiling dome, tray or other shape or configuration.

It is another object of the present invention to manufacture sections of a support collar which inter-engage to form the appearance of a continuous support collar and which are secured together and secured to ceiling joists to form a support surface for a ceiling dome tray or other shape or configuration. with each of the collar sections including a grooved recess for receipt of a lighting element.

It is still yet another object of the present invention to manufacture sections of a support collar which inter-engage to form the appearance of a continuous support collar and which are secured together and secured to ceiling joists to form a support surface for a ceiling dome tray or other shape or configuration. with each of the collar sections including a grooved recess for receipt of a lighting element and with end portions of the collar sections having inter-engaging male and female portions to secure the collar sections together and provide the appearance of the continuous support collar.

It is still yet another object of the present invention to manufacture sections of a support collar which inter-engage to form the appearance of a continuous support collar and which are secured together and secured to ceiling joists to form a support surface for a ceiling dome tray or other shape or configuration. with each of the collar sections including a grooved recess for receipt of a lighting element and with end portions of the collar sections having inter-engaging male and female portions to secure the collar sections together and provide the appearance of the continuous support collar and with a weight displacement pan mounted on top of the dome to distribute weight forces of an attachment suspended from the dome.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the support collar for modular ceiling insert disclosed herein, and are for illustrative purposes only. Other embodiments that are substantially similar can use other components that have a different appearance.

DETAILED DESCRIPTION OF THE PREFERRED EMBODIMENTS

Figure 1:
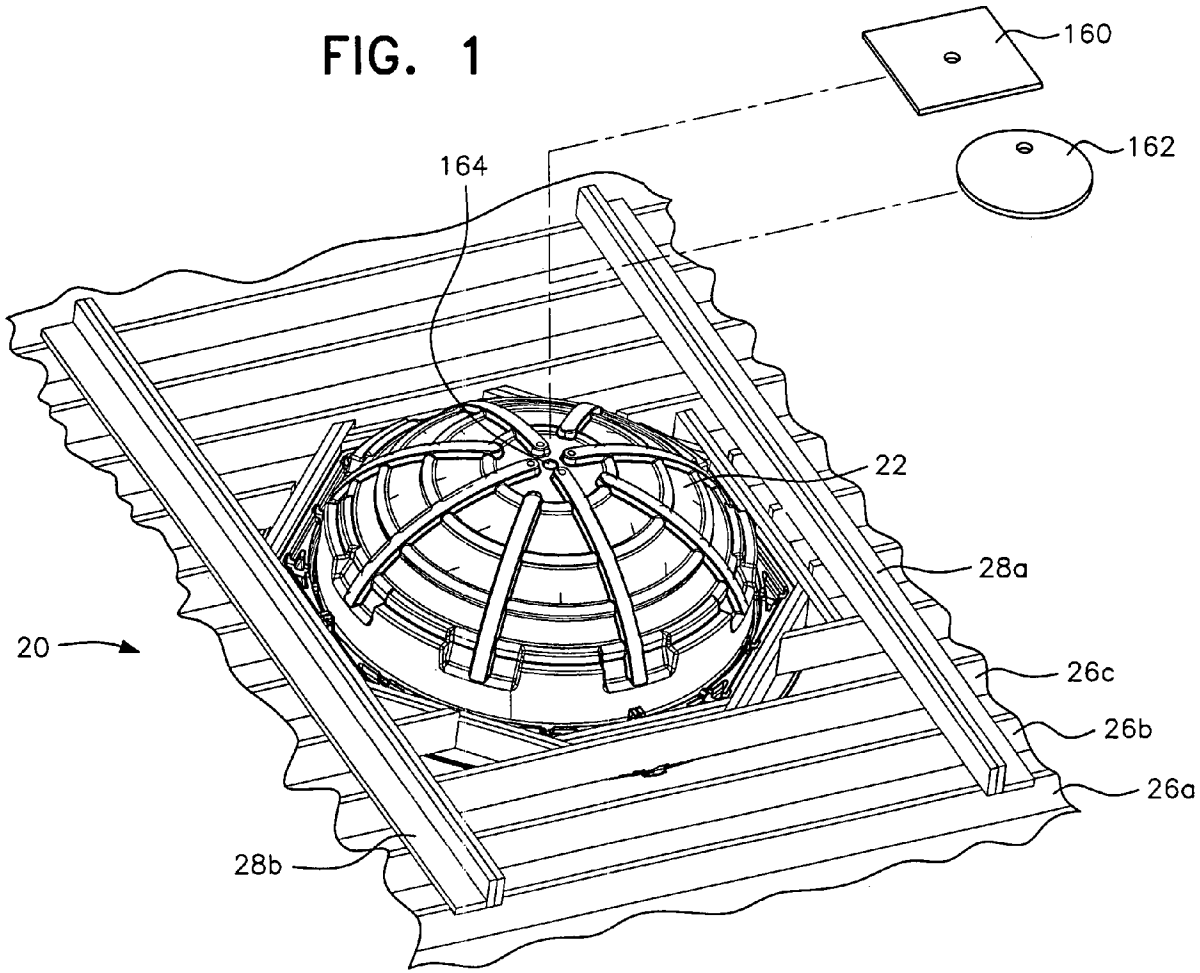
FIG. 1 is a perspective view of the reinforced ceiling supports for an interconnected support collar of the present invention and illustrating a modular ceiling insert mounted on the support collar and the optional use of a weight displacement pan.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1-5, in particular, a first example of a support collar for a modular ceiling insert embodying the teachings of the subject invention is generally designated as 20. With reference to its orientation in FIG. 1, the upper side of a modular ceiling insert 22 is shown. The ceiling insert 22 projects above a ceiling 24 having a plurality of parallel extending joists 26*a*, 26*b*, 26*c*, 26*d*, 26*e*, 26*f*, 26*g*, 26*h*, 26*i*, 26*j*, 26*k*. Further structural support is provided by assembled groups of parallel extending joists 28*a*, 28*b* which extend perpendicular to joists 26.

Figure 2:
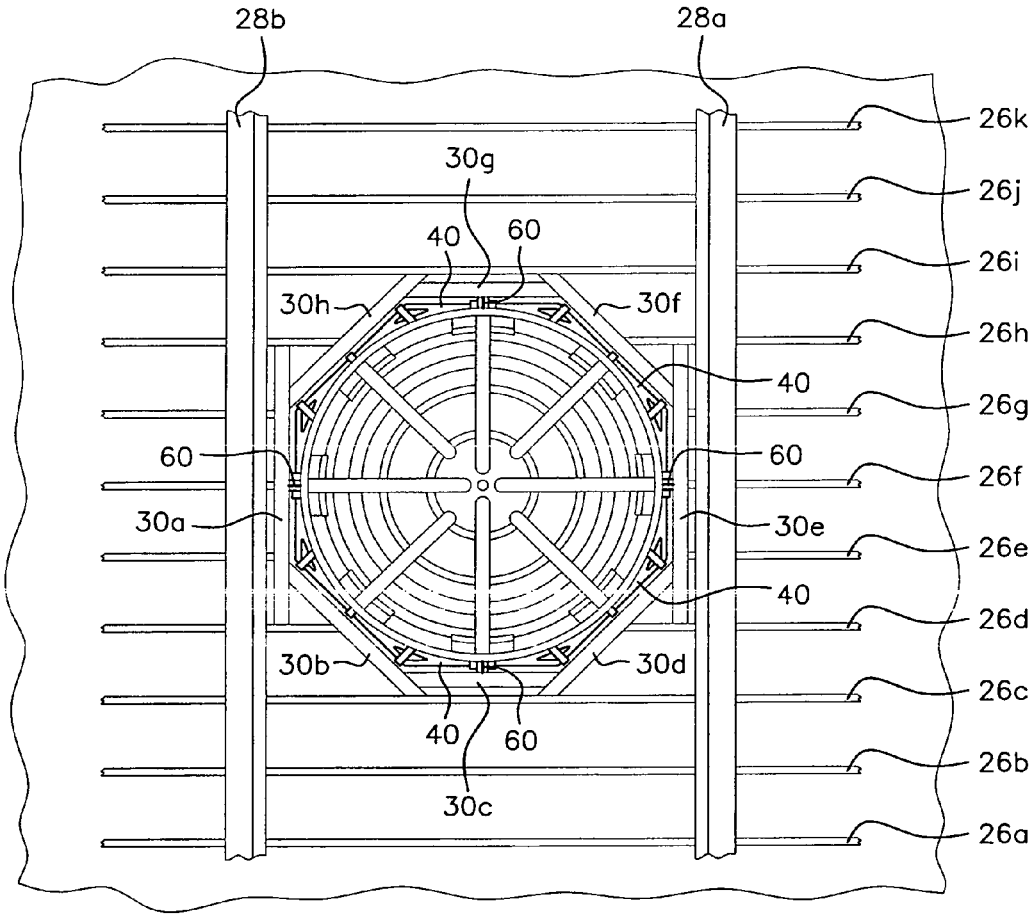
FIG. 2 is a plan view of a modular ceiling insert and its support collar extending into an attic space above a ceiling.
Figure 4:
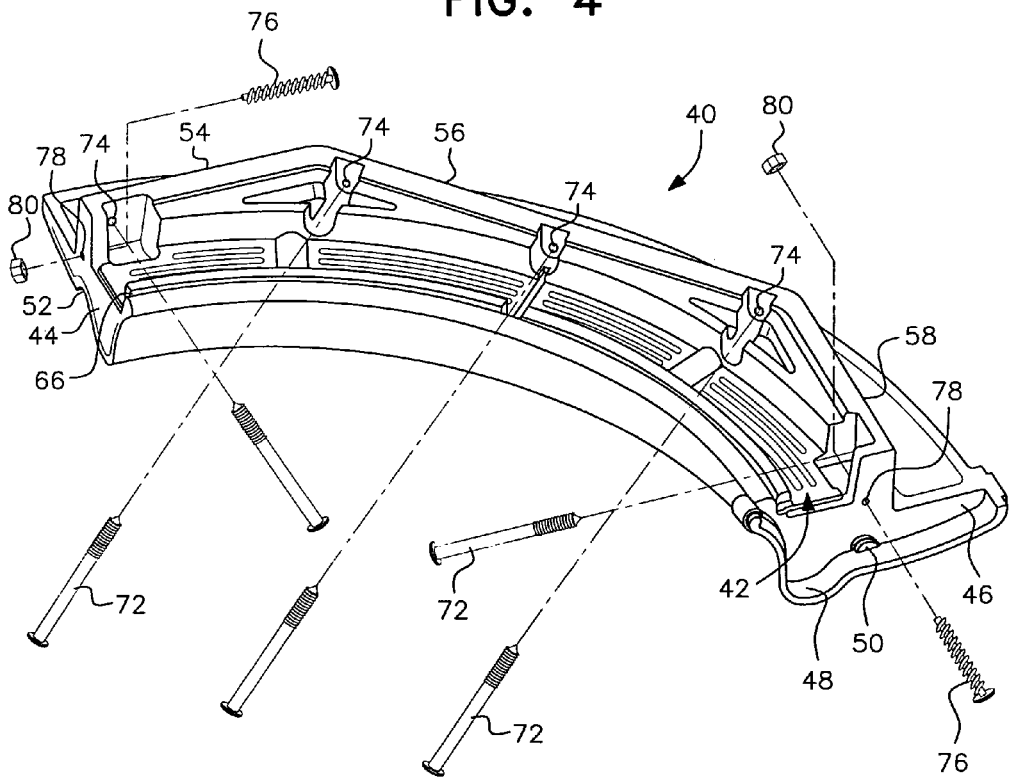
FIG. 4 is a perspective view of a one-quarter section of a support collar embodying the principles of the present invention.
Figure 5:
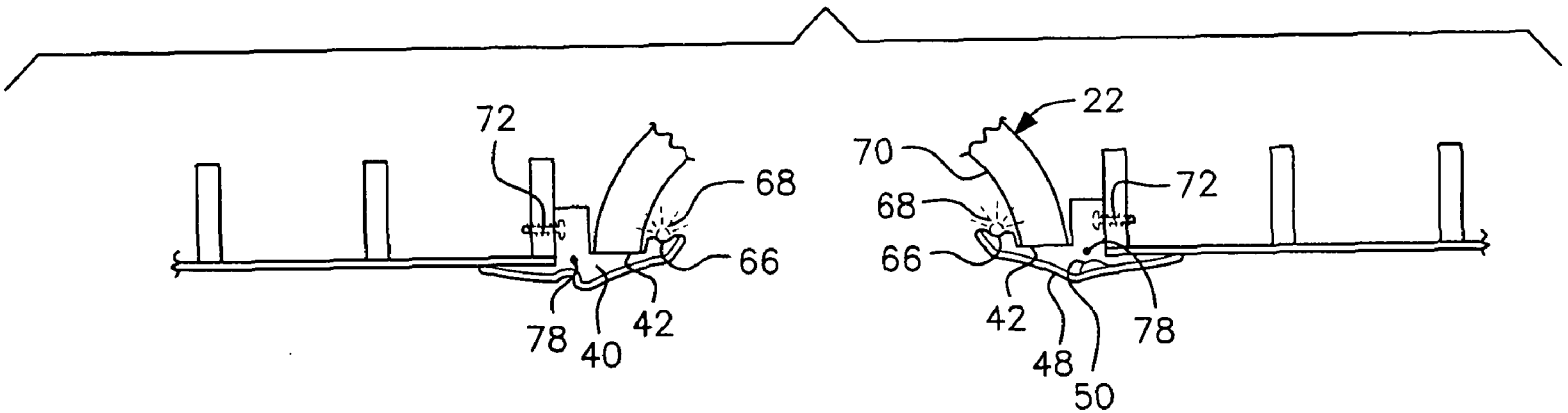
FIG. 5 is a partial sectional view illustrating the mounting of the support collar to support joists of a ceiling structural support and having a modular ceiling insert resting on the support collar and including a light kit.

As shown in FIG. 2, a particular configuration of ceiling structural supports is defined by a plurality of joists forming an octagon configuration. The sides of the ceiling structural supports are formed by joists 30*a*, 30*b*, 30*c*, 30*d*, 30*e*, 30*f*, 30*g*, 30*h*. Secured to the ceiling structural supports 30*a*-30*h* are four support collar sections 40 as shown in FIG. 4.

Each support collar section 40 includes a curved support portion 42 for supporting a peripheral edge of a modular ceiling insert 22. Opposed end edges 44, 46 cooperate with adjacent support collar sections to interconnect adjacent support collar sections together and thereby define an opening to be filled by the modular ceiling insert 22. End portion 46 includes a support flange 48 and a projection 50 for inter-engaging and supporting end 44 of an adjacent support collar section with the projection 50 fitting into a corresponding recess 52 of end portion 44 of an adjacent support collar section.

Each of the support collar sections 40 include three vertically extending flat engagement portions, 54, 56 and 58. Portions 54 and 58 are half the length of portion 56 so that when an adjacent support collar section is engaged with the section 40 shown in FIG. 4, the section 58 of the support collar section 40 and the section 54 of an adjacent support collar section will be equal in width to that of portion 56.

Figure 3:
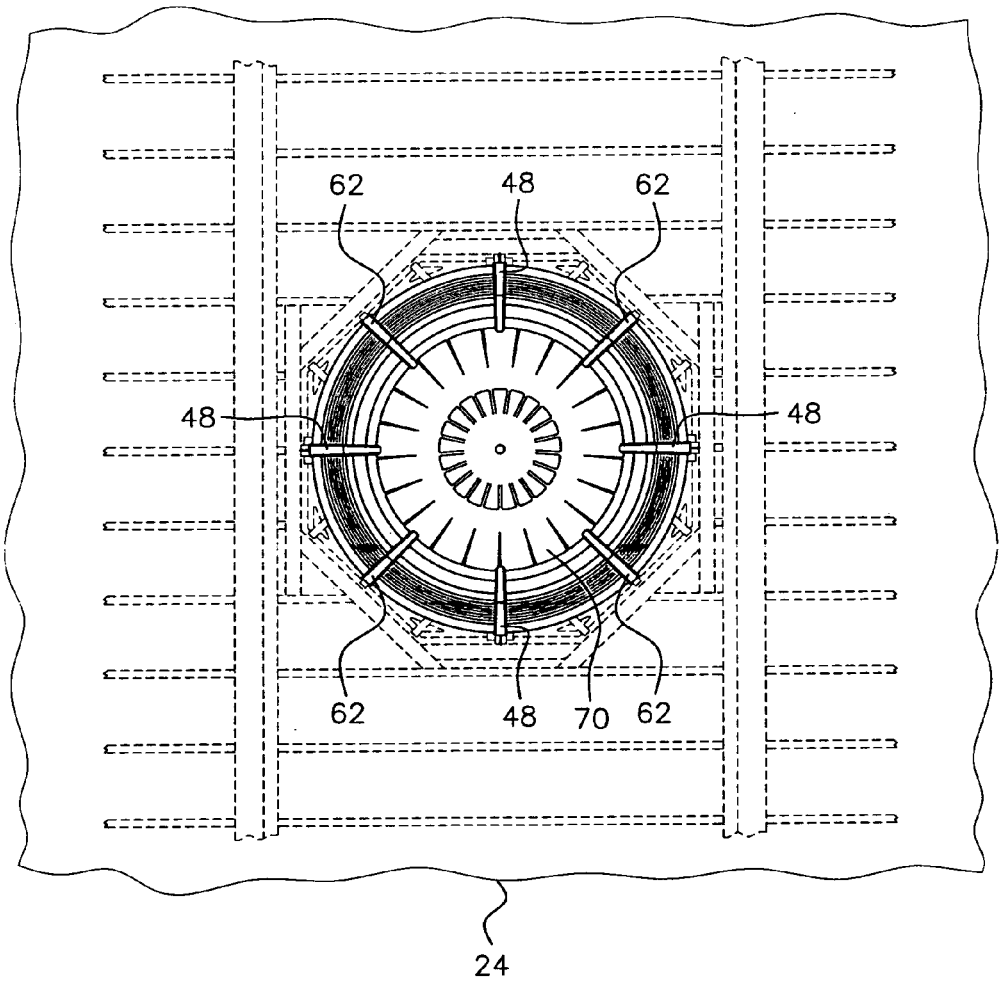
FIG. 3 is a bottom view showing the appearance of a mounted modular ceiling insert supported by the support collar of the present invention with the ceiling structural supports located above the ceiling shown in dotted lines.

Therefore, as shown in FIG. 2, four support collar sections 40 are shown with four engagement-seam lines 60 separating adjacent sections 40. However, due to the resting of end 52 on top of flange 48 of an adjacent support collar section, at least four flanges 48 will be seen when looking up from the floor to the ceiling assembly of support collar sections and modular ceiling insert as shown in FIG. 3. The flange portions 62 located between the flange portions 48 in FIG. 3 are for decorative purposes only and need not be present.

Each support collar section 40 includes a peripheral groove 66 for support of a rope like kit or a fiber optic rope 68. The illumination from groove 66 provides illumination of the underside 70 of the modular ceiling insert 22.

As shown in FIG. 4, the support collar section 40 is secured in place to ceiling structural supports 30*a*-30*k* by lag bolts 72 extending through openings 74 in the vertically extending flat engagement portions so as to inter-engage and secure the support collar sections to the ceiling structural supports. In addition, draw bolts 76 are used to extend through lateral openings 78 in the ends 44, 46 of the collar sections 40 and be engaged by nuts 80 to draw together and secure adjacent support collar sections together.

Depending upon an amount of attic space located above the ceiling 24, the support collar section 40, having a width of one foot, can be used in an eight foot opening to support a six foot diameter modular ceiling insert. Alternatively, as shown in FIGS. 6-10, a twelve foot opening can be used with eight support collar sections 100, as shown in FIG. 9, each having a width of three feet, to support a six foot diameter modular ceiling insert 102.

Figure 6:
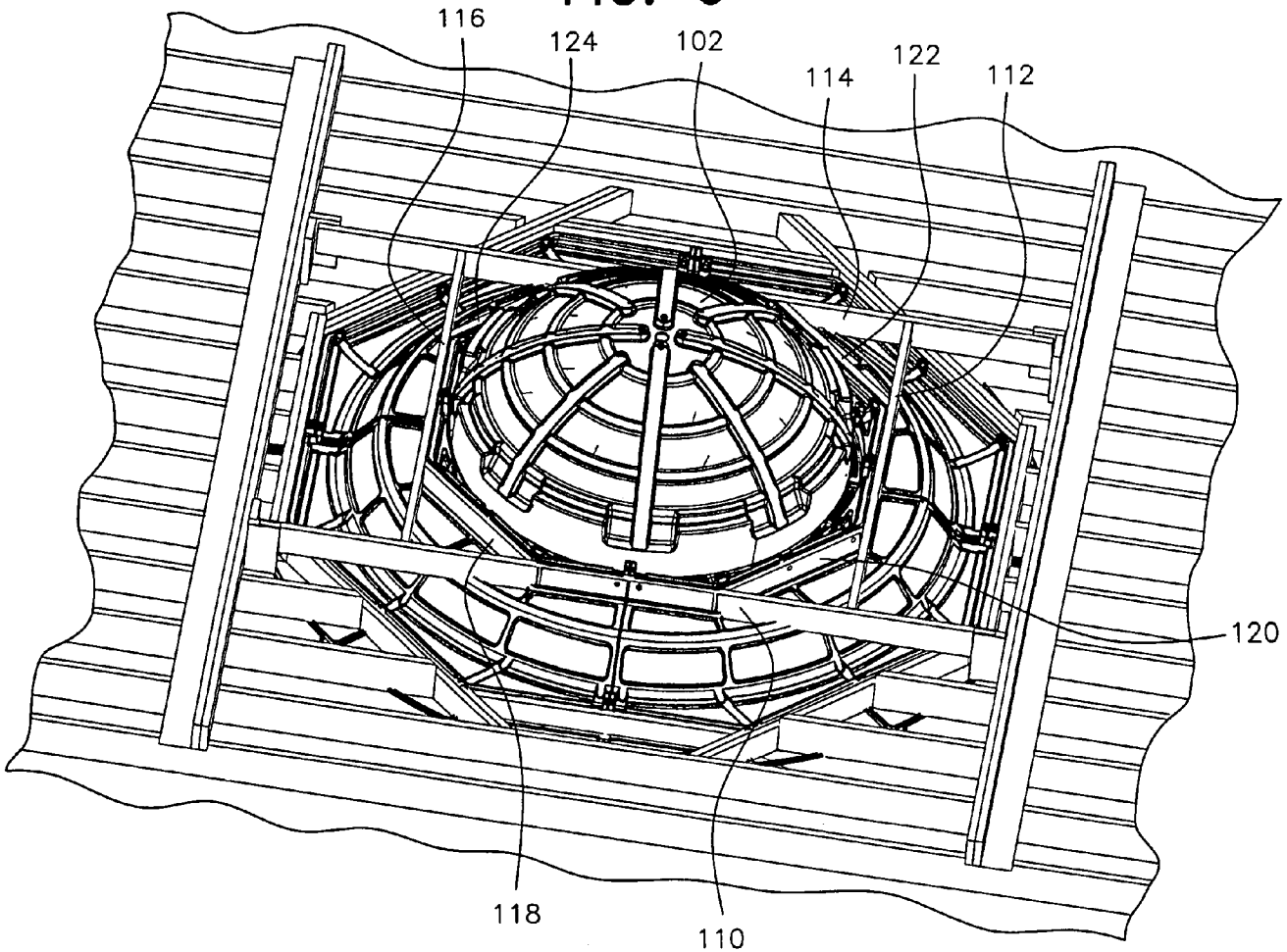
FIG. 6 is a perspective view of an alternate embodiment of the reinforced ceiling supports for an interconnected support collar of the present invention and illustrating a modular ceiling insert mounted on the support collar.
Figure 7:
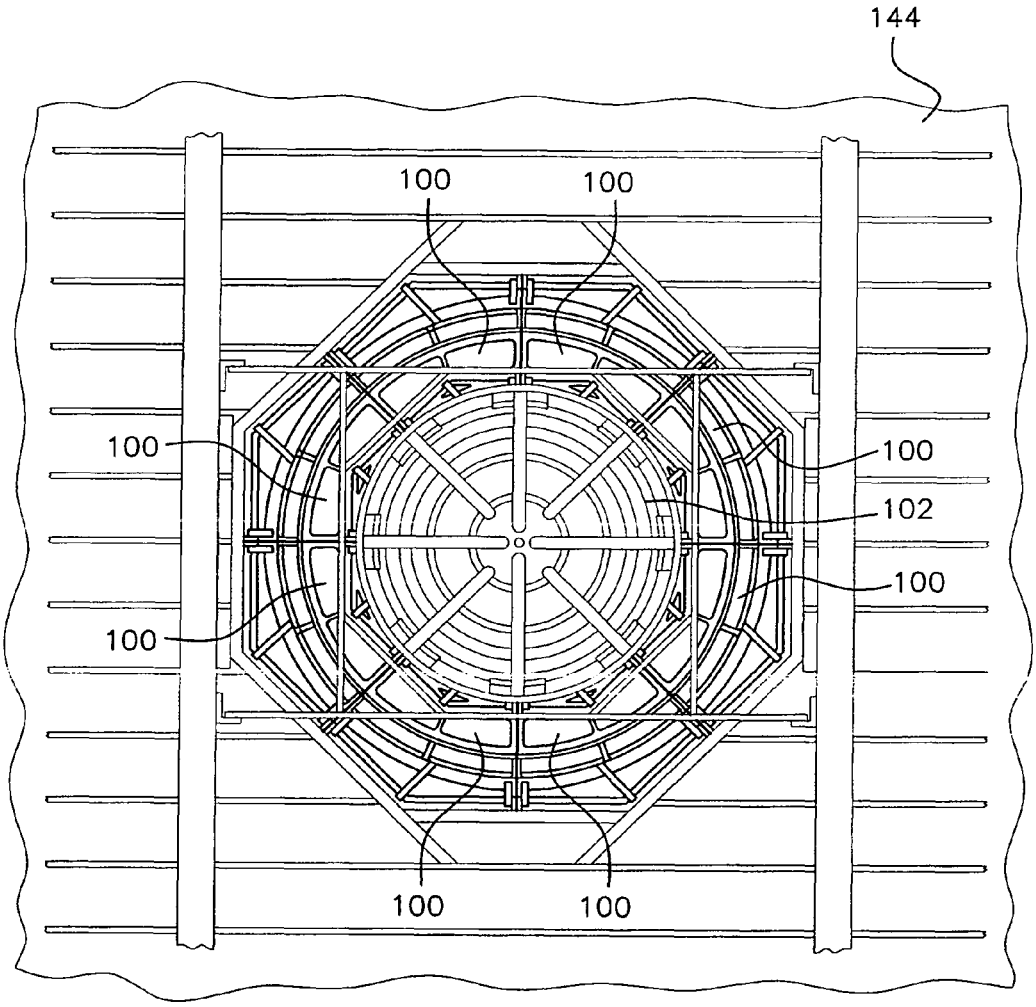
FIG. 7 is a plan view of a modular ceiling insert and its support collar extending into an attic space above a ceiling.
Figure 8:
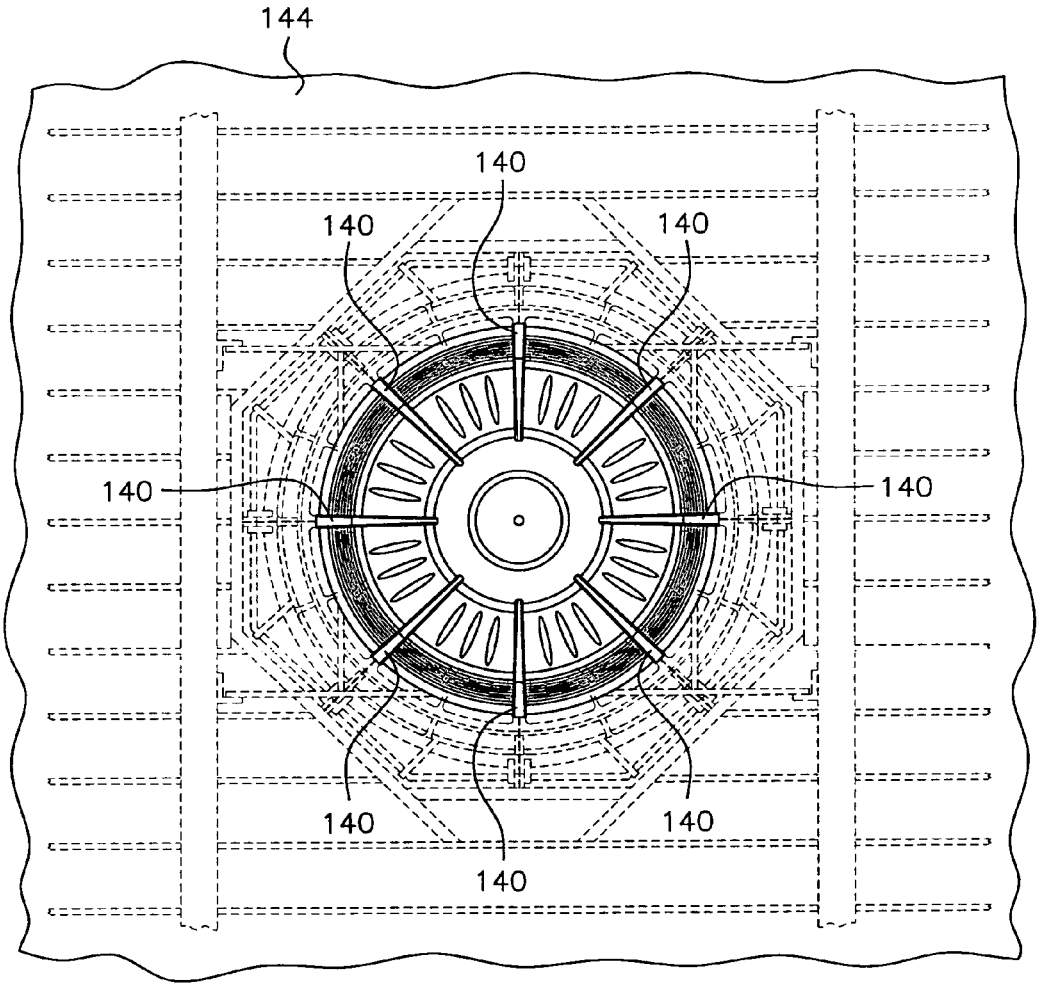
FIG. 8 is a bottom view showing the appearance of a mounted modular ceiling insert supported by the support collar of the present invention with the ceiling structural supports located above the ceiling shown in dotted lines.
Figure 9:
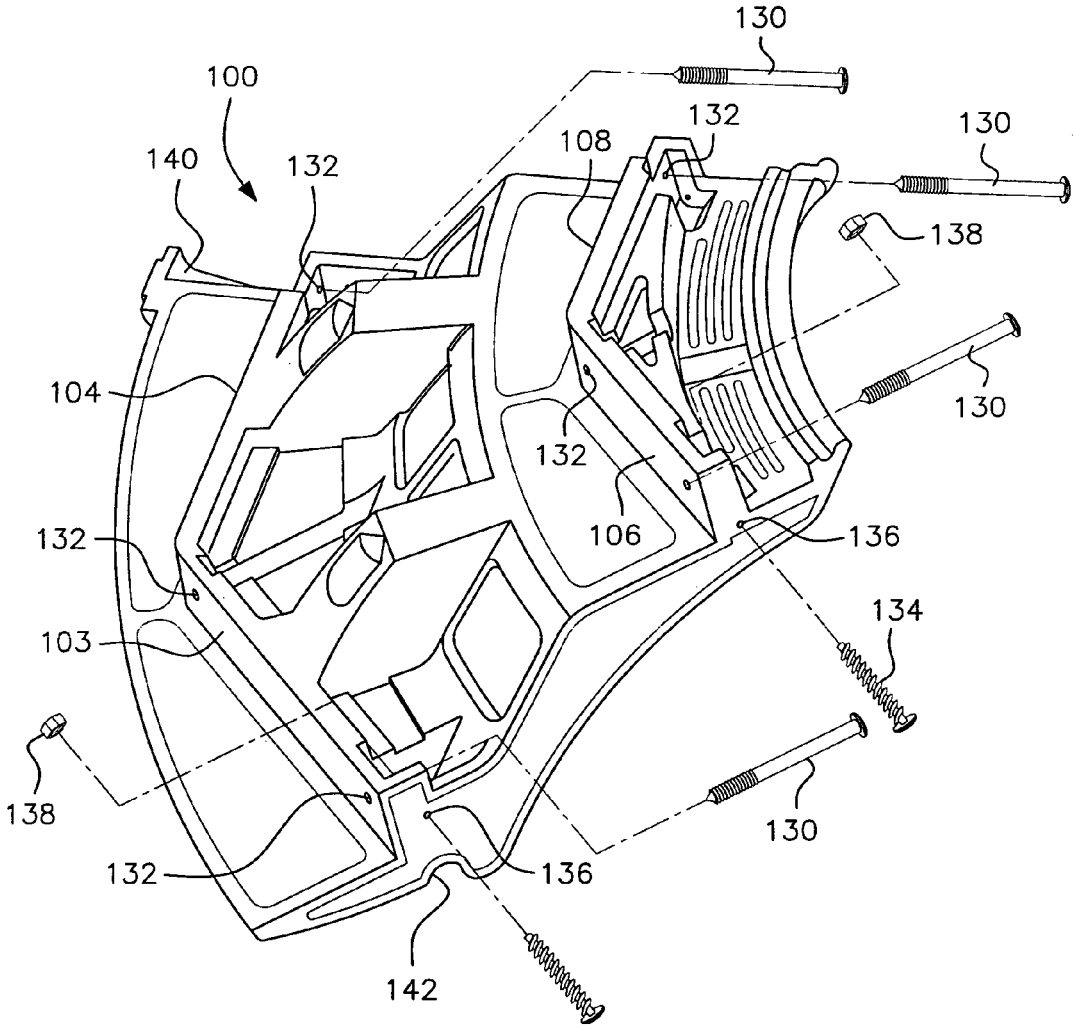
FIG. 9 is a perspective view of a one-eighth section of a support collar embodying the principles of the present invention.
Figure 10:
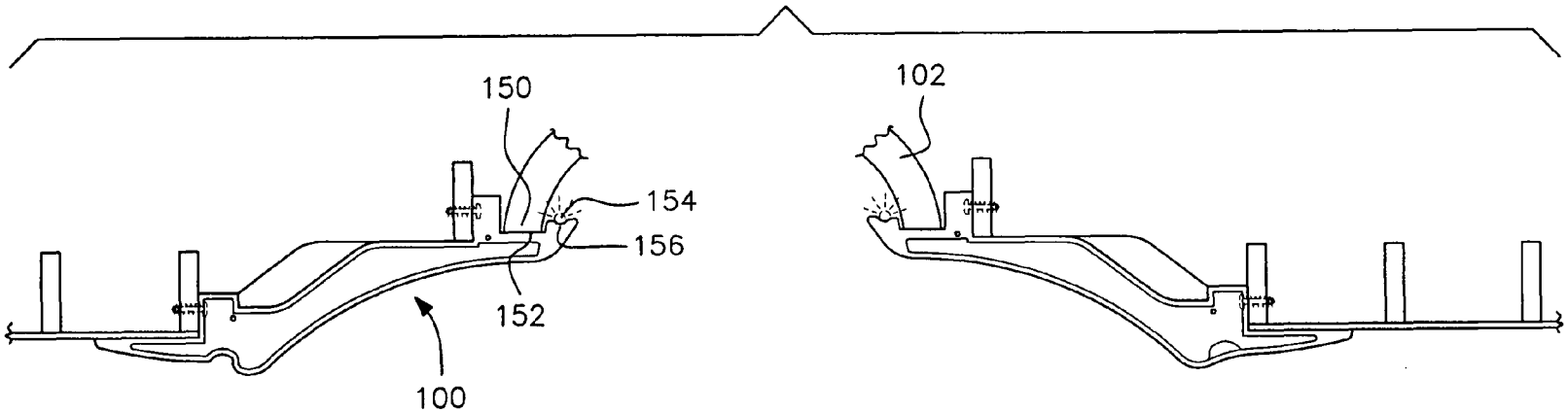
FIG. 10 is a partial sectional view illustrating the mounting of the support collar to support joists of a ceiling structural support and having a modular ceiling insert resting on the support collar and including a light kit.

With the support collar section shown in FIG. 9, a more elaborate ceiling structural support must be provided as shown in FIGS. 6 and 7. The support collar section 100 includes two levels of vertically extending flat engagement portions 103, 104 at one level, and 106, 108 at an upper level. An octagonal shaped series of ceiling structural supports as shown in FIG. 6 for the lower engagement portions 102 and 104 and an upper series of ceiling structural supports 110, 112, 114 and 116 forming a square are provided to engage every other set of engagement portions 106, 108 of interconnected support collar sections 100. Diagonally extending supports 118, 120, 122, 124 engage the remainder of the upper level of engagement portions of the support collar section 100.

To complete the support collar for the modular ceiling insert 102 shown in FIGS. 6 and 7, a series of eight support collar sections 100 are required to be interconnected. As was explained with reference to FIGS. 4 and 5, a plurality of lag bolts 130 extend through openings 132 in the collar section to engage with the joists and constructed structural supports located above the ceiling 144. Also, draw bolts 134 are passed through openings 136 into adjacent collar sections 100 for engagement with nuts 138 to draw together and secure adjacent collar sections together with inter-engaged edges being supported by and covered by eight flanges 140. Flanges 140 have a projection for engaging with a recess 142 of an opposed edge of an adjacent support collar section.

The lowermost edge 150 of the modular ceiling insert 102 is supported in a groove 152 of the support collar section 100. A light rope or fiber optic kit 154 is supported in a recess 156 of the collar section.

In the embodiment in FIGS. 1-5 and the embodiment of FIGS. 6-10, a weight displacement pan 160 or 162 as shown in FIG. 1 may be secured to the top of the modular ceiling insert. The pan 160 is flat and provides an anchoring strengthener for supporting an electrical or decorative fixture hanging through opening 164 in the top of the modular ceiling insert. Alternatively, the displacement pan 162 may be curved to the configuration of the upper surface of the modular ceiling insert.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A support collar section for a modular ceiling insert, said support collar comprising a prefabricated modular body having a support portion for supporting a peripheral edge of a modular ceiling insert, opposed end edges for cooperating with adjacent support collar sections to interconnect adjacent support collar sections together and thereby define an opening to be filled by the modular ceiling insert, the opposed end edges include a male portion and a female portion respectively for cooperation and interengagement with adjacent bodies, at least two vertically extending flat engagement portions for engaging and being secured to ceiling joists located above a ceiling, one of said opposed end edges including a support flange projecting beyond a terminal end of the at least two vertically extending flat engagement portions for engaging and overlapping an adjacent prefabricated modular body, and said support portions of a plurality of said prefabricated bodies extending inwardly beyond said vertically extending flat engagement portions and forming a support surface for the peripheral edge of the modular ceiling insert so that the modular ceiling insert projects above the plurality of said prefabricated bodies into an attic space above ceiling joists of a ceiling.

2. The support collar section for a modular ceiling unit as claimed in claim 1, wherein said opposed end edges include at least one preformed opening for passage therethrough of a connector.

3. The support collar section for a modular ceiling unit as claimed in claim 1, wherein said engagement portions include at least one preformed opening for passage therethrough of a connector and engagement with the ceiling joists.

4. The support collar section for a modular ceiling unit as claimed in claim 1, wherein the opening and the support portions defined by the plurality of bodies is circular.

5. The support collar section for a modular ceiling unit as claimed in claim 1, wherein a path of the support surfaces defined by the plurality of bodies is continuous.

6. A ceiling assembly for aesthetically altering a ceiling structure, said ceiling assembly comprising a modular ceiling insert, ceiling structural supports including ceiling joists defining an opening for receipt of and supporting a weight of the modular ceiling insert, a plurality of prefabricated modular bodies interconnected and secured to said ceiling joists and supporting a peripheral edge of said modular ceiling insert, said plurality of prefabricated modular bodies projecting above and below the opening of the ceiling joists, each of said plurality of prefabricated modular bodies including a support portion supporting a peripheral edge of the modular ceiling insert at a location spaced radially outwardly from an inner peripheral edge of the prefabricated modular bodies, opposed end edges cooperating with and overlapping adjacent ones of said plurality of prefabricated modular bodies to interconnect adjacent ones of said plurality of prefabricated modular bodies together and thereby define an opening to be filled by the modular ceiling insert, vertically extending fiat engagement portions located above a bottom of the ceiling joists and said vertically extending flat engagement portions laterally engaging and being secured to the ceiling joists at a plurality of locations for each prefabricated modular body, one of said opposed end edges including a support flange projecting beyond a terminal end of the vertically extending flat engagement portions, said support portions of said plurality of prefabricated modular bodies extending inwardly beyond said vertically extending flat engagement portions and forming a support surface for the peripheral edge of the modular ceiling insert, said modular ceiling insert projecting above the plurality of prefabricated bodies and above the opening of the ceiling joists into an attic space above the ceiling joists.

7. The ceiling assembly for aesthetically altering a ceiling structure as claimed in claim 6, wherein said modular ceiling insert is prefabricated for installation as a single piece.

8. The ceiling assembly for aesthetically altering a ceiling structure as claimed in claim 6, wherein said ceiling joists are located above a lowermost portion of said plurality of bodies.

9. The ceiling assembly for aesthetically altering a ceiling structure as claimed in claim 6, wherein the opposed end edges include male and female portions for cooperation and interengagement with adjacent bodies.

10. The ceiling assembly for aesthetically altering a ceiling structure as claimed in claim 6, wherein said opposed end edges include at least one opening for passage therethrough of a connector.

11. The ceiling assembly for aesthetically altering a ceiling structure as claimed in claim 6, wherein said vertically extending flat engagement portions include at least one opening for passage therethrough of a connector and engagement with the ceiling joists.

12. The ceiling assembly for aesthetically altering a ceiling structure as claimed in claim 6, wherein the opening and the support portions defined by the plurality of bodies is circular.

13. The ceiling assembly for aesthetically altering a ceiling structure as claimed in claim 6, wherein a path of the support surfaces defined by the plurality of bodies is continuous.

14. The ceiling assembly for aesthetically altering a ceiling structure as claimed in claim 6, wherein each of the plurality of bodies includes a groove for supporting a lighting fixture.

15. The ceiling assembly for aesthetically altering a ceiling structure as claimed in claim 6, wherein a weight displacement pan is mounted on the modular ceiling unit.

16. The ceiling assembly for aesthetically altering a ceiling structure as claimed in claim 6, wherein the plurality of prefabricated modular bodies are of equal size.

17. The ceiling assembly for aesthetically altering a ceiling structure as claimed in claim 6, wherein said vertically extending flat engagement portions extend between said opposed end edges.

18. The support collar section for a modular ceiling unit as claimed in claim 1, wherein the at least two vertically extending flat engagement portions extend between the opposed end edges of the prefabricated modular body.

19. The support collar section for a modular ceiling unit as claimed in claim 1, wherein one of the at least two vertically extending flat engagement portions is one half a length of another of the at least two vertically extending flat engagement portions.

* * * * *